US006113467A

United States Patent [19]

Koike

[11] Patent Number: 6,113,467

[45] Date of Patent: Sep. 5, 2000

[54] POLISHING MACHINE AND POLISHING METHOD

[75] Inventor: Eijiro Koike, Tokyo, Japan

[73] Assignee: Kabushiki Kaisha Toshiba, Kawasaki, Japan

[21] Appl. No.: 09/251,909

[22] Filed: Feb. 19, 1999

[30] Foreign Application Priority Data

Apr. 10, 1998 [JP] Japan ..... 10-099030

[51] Int. Cl.[7] ..... B24B 1/00

[52] U.S. Cl. ..... 451/41; 41/36; 41/262

[58] Field of Search ..... 451/36, 63, 262, 451/41, 160

[56] References Cited

U.S. PATENT DOCUMENTS

| | | | |
|---|---|---|---|
| 4,588,473 | 5/1986 | Hisatomi et al. | 451/63 X |
| 4,821,466 | 4/1989 | Kato et al. | 451/113 X |
| 5,205,082 | 4/1993 | Shendon et al. . | |
| 5,419,735 | 5/1995 | Imahashi et al. | 451/113 |
| 5,575,706 | 11/1996 | Tsai et al. | 451/36 X |
| 5,624,300 | 4/1997 | Kishii et al. | 451/36 |

FOREIGN PATENT DOCUMENTS

| | | | |
|---|---|---|---|
| 360186368 | 9/1985 | Japan | 451/288 |
| 363127872 | 5/1988 | Japan | 451/63 |

OTHER PUBLICATIONS

Kazuo Kobayashi, et al. "Development of Fully Automatic Precision Polishing (CMP) System", ISAT, Nov. 21, 1998, pp. 97–100.

*Primary Examiner*—David A. Scherbel
*Assistant Examiner*—Anthony Ojini
*Attorney, Agent, or Firm*—Oblon, Spivak, McClelland, Maier & Neustadt, P.C.

[57] ABSTRACT

A method of polishing which includes rotatably supporting a workpiece, positioning polishing plates in such a manner that flat surfaces of the polishing plates oppose one another and are in contact with a surface of the workpiece, and polishing the workpiece by rotating the workpiece around a central axis thereof by use of a workpiece rotator. The method also includes reciprocating the polishing plates on the surface of the workpiece in a radial direction of the workpiece while pressing the workpiece between the flat surfaces of the polishing plates.

6 Claims, 1 Drawing Sheet

POLISHING MACHINE AND POLISHING METHOD

BACKGROUND OF THE INVENTION

1. Field of the Invention

The present invention relates to a polishing machine and a polishing method of polishing work pieces such as semiconductor device wafers, or optical parts, functional parts, mechanical parts, etc. that require parallelism and flatness, and particularly to enhancement of the parallelism and flatness of the work piece realized by simultaneously polishing both front and back surfaces of each work piece, and miniaturization of the machine.

2. Discussion of the Background

As a polishing machine which polishes both surfaces of a disc-like work piece such as a semiconductor device wafer, a batch-type polishing machine 10 for loading a plurality of wafers W at one time as shown in FIG. 4 is well known. In the polishing machine 10, an upper surface plate 11 and a lower surface plate 12 are provided to face one another and a plurality of wafers W supported by internal gears 13 are loaded between the upper surface plate 11 and the lower surface plate 12. The internal gears 13 revolves while rotating around a sun gear 14 provided at the center of the machine. With this structure, both surfaces of each wafer W are uniformly polished by polishing cloths 11*a* and 12*a* provided respectively on the upper surface plate 11 and the lower surface plate 12.

The above-described conventional batch-type polishing machine 10 has the following problem. A plurality of wafers W are processed simultaneously, and S if the thicknesses of the wafers W before polished are not uniform, the upper surface plate 11 or the lower surface plate 12 is inclined, which causes poor accuracy in the parallelism or flatness after the polishing.

Further, it is difficult to uniformly adjust the thicknesses of large wafers W such as Si wafers whose diameter ranges 8 to 12 inches, before polishing.

On the other hand, as such a polishing machine 10 is structurally in a large scale, the upper surface plate 11 and the lower surface plate 12 are larger as the wafers W are larger, which makes high accuracy flattening and management of the surface plates that influence the accuracy in polishing difficult. At the same time, the required installation area of the polishing machine 10 is increased, and installing it in a limited space such as a clean room and the like is limited.

BRIEF SUMMARY OF THE INVENTION

The present invention aims at keeping the parallelism and flatness at high accuracy even when both surfaces of a work piece such as a semiconductor device wafer and the like having a large diameter are polished simultaneously.

The present invention comprises a support unit for horizontally supporting a work piece at an outer peripheral edge thereof, to be freely rotatable with a central axis thereof serving as a center of the rotation; a rotation driving unit for driving rotation of the work piece with the central axis thereof serving as a center of the rotation; a polishing plate provided to be opposite to a surface of the work piece and reciprocate along a direction of a diameter of the work piece, and pressed onto the surface of the work piece at a predetermined force; and polishing cloth provided between the polishing plate and the surface of the work piece.

In the present invention, an outer peripheral edge of a work piece is supported, the work piece is rotated with its central axis serving as the center of rotation, and polishing cloth is reciprocated along the direction of the diameter of the work piece. Thus, the shape of polishing plates formed at high accuracy can be transferred onto the work piece. Therefore, even when a work piece having a large diameter is polished, the parallelism and flatness can be kept at high accuracy. On the other hand, as work pieces can be polished one by one, the machine can be miniaturized.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

The present invention will be described below with reference to the figures.

Figure 1:
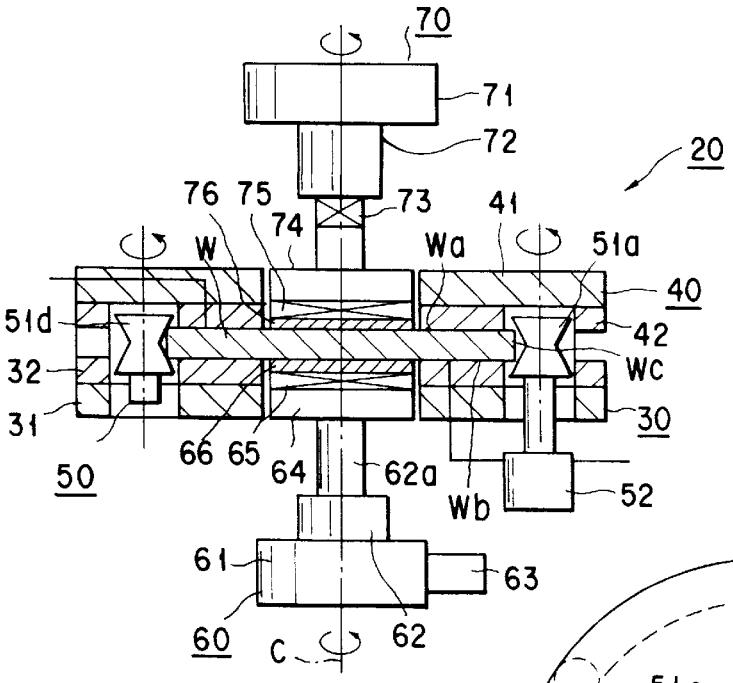
FIG. 1 is a horizontally sectional view showing a polishing machine according to an embodiment of the present invention.

FIG. 1 is a horizontally sectional view showing a polishing machine 20 according to an embodiment of the present invention. The polishing machine 20 comprises a lower surface plate 30 provided at a lower surface Wb side of a disc-like wafer W which is a work piece, an upper surface plate 40 provided at an upper surface Wa side of the wafer W, a wafer supporting unit 50 for supporting an outer peripheral edge Wc of the wafer W, a lower polishing plate mechanism 60 provided at the lower surface plate 30 side, and an upper polishing plate mechanism 70 provided at the upper surface plate 40 side.

Figure 2:
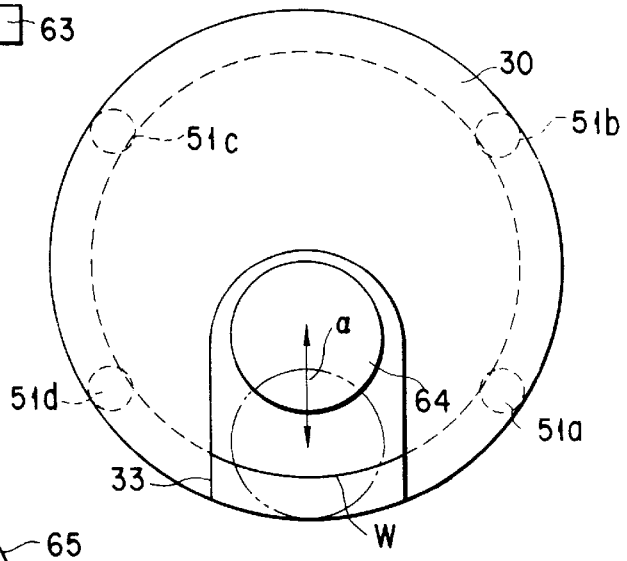
FIG. 2 is a view illustrating operations of a lower polishing plate incorporated in the polishing machine.

The lower surface plate 30 is constituted by overlapping a disc-like metal plate 31 and an elastic plate 32 formed of a material more flexible than the metal plate 31, and a cutaway portion 33 is formed from the outer periphery side to the center side of the lower surface plate 30 as shown in FIG. 2. A polishing liquid supply hole 34 is provided at the elastic plate 32 to supply a polishing liquid onto the lower surface Wb of the wafer W. If abrasive grains agreeing with the work piece and a suspended magnetic fluid are used for the polishing liquid, the polishing efficiency is improved. For example, for polishing of glass or an oxide film, a colloidal magnetic fluid including $CeO_2$, ferrite or the like as the abrasive grain material is used. A colloidal magnetic fluid including ferrite containing colloidal silica as a polishing material is used here as the work piece is an Si wafer W.

The upper surface plate 40 is constituted by overlapping a disc-like metal plate 41 and an elastic plate 42 obtained by applying cloth onto a surface of sponge or rubber, and a cutaway portion 43 corresponding to the above-mentioned cutaway portion 33 is formed at the upper surface plate 40. A polishing liquid supply hole 44 is provided at the elastic plate 42 to supply a polishing liquid onto the upper surface Wa of the wafer W.

The wafer supporting unit 50 comprises four guides 51*a* to 51*d* holding the outer peripheral edge Wc of the wafer W to be freely rotatable and rotating themselves around an axis G in FIG. 1, and a work piece rotating motor 52 for driving the rotation of the guide 51*a*.

Figure 3:
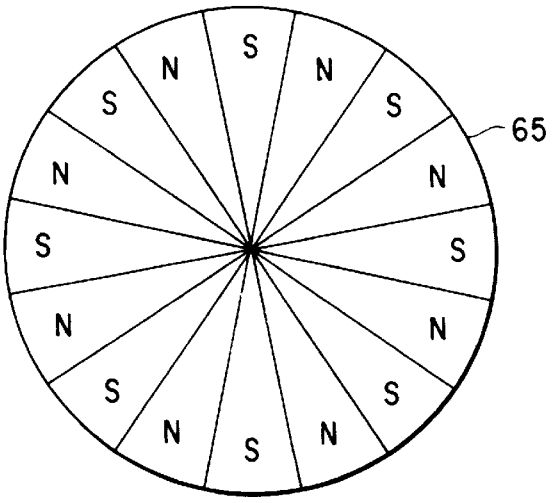
FIG. 3 is a plan view illustrating arrangement of magnetic poles on an electromagnetic unit incorporated in the polishing machine.
Figure 4:
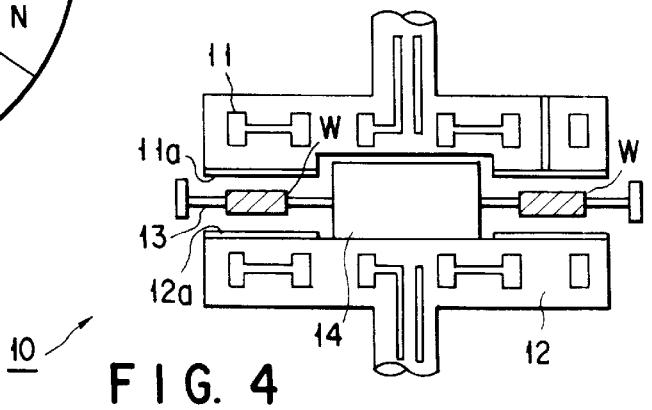
FIG. 4 is a horizontally sectional view showing a conventional two-surface polishing machine.

The lower polishing plate mechanism 60 comprises a lower polishing plate reciprocating guide 61 provided in the direction of the diameter of the wafer W, i.e. from the lower side of a central axis C to the lower side of outer peripheral edge Wc, a polishing cloth rotating motor 62 provided to freely reciprocate along the guide 61, a lower polishing plate reciprocating motor 63 for reciprocating the motor 62, and a lower polishing plate 64 provided at a shaft unit 62*a* of the motor 62 to face the lower surface Wb of the wafer W. An electromagnet 65 and polishing cloth 66 are provided on the lower polishing plate 64. The electromagnet 65 as the magnetic unit applying a magnetic force onto the work piece is constituted such that the N pole and the S pole are arranged alternately as shown in FIG. 3.

The upper polishing plate mechanism 70 comprises an upper polishing plate reciprocating guide 71 provided in the direction of the diameter of the wafer W, i.e. from the upper side of the central axis C to the upper side of the outer peripheral edge Wc, a pressure adding mechanism 72 provided to freely reciprocate along the guide 71, for generating a pressing force downward in FIG. 1 on an upper polishing plate 74 described later, and an upper polishing plate 74 provided at the pressure adding mechanism 72 via a flexible joint 73 to face the upper surface Wa of the wafer W. An electromagnet 75 and polishing cloth 76 are provided at the upper polishing plate 74.

In the polishing machine 20 thus constituted, the wafer W is polished in the following manners. First, the wafer W is held by the guides 51*a* to 51*d*. Then, the elastic plates 32 and 42 are positioned so that much pressure is not applied to the wafer W. Thus, it is possible to prevent the wafer W from shaking during the polishing process and stably rotate the wafer W.

In addition, a current is made to pass through the electromagnets 65 and 75. At this time, they are controlled so that the magnet poles at the opposite positions of the electromagnets 65 and 75 can be reverse to one another. Thus, the sucking force from the lower polishing plate 64 is applied to the upper polishing plate 74, the upper polishing plate 74 follows the lower polishing plate 64, and the wafer W can be prevented from being scratched and can be polished effectively.

The upper polishing plate 74 is made to approach the wafer W by means of the lower polishing plate 64 and the pressure adding mechanism 72 and the polishing cloths 66 and 76 are pressed onto the lower surface Wb and upper surface Wa of the wafer W.

Then, the motor 52 is operated to rotate the wafer W around its central axis C and also rotate the motor 62. Thus, the polishing cloth 66 is rotated and the polishing cloth 76 is also rotated.

By reciprocating the motor 62 by means of the motor 63, the polishing cloth 66 is reciprocated along a direction represented by an arrow $\alpha$ in FIG. 2 and the polishing cloth 76 is also reciprocated.

On the other hand, a polishing liquid is supplied from the polishing liquid supply holes 34 and 44. Even if abrasive grains enter the elastic plates 32 and 42 during the work, they do not influence the polishing process, the surface of the wafer W is not thereby scratched.

When a magnetic fluid is used as the polishing liquid, the polishing liquid is collected near the polishing cloths 66 and 76 by the electromagnets 65 and 75, the polishing liquid can be used efficiently and the polishing efficiency can be enhanced.

As described above, the polishing machine 10 according to the present embodiment polishes the wafer W one by one, and even if the thicknesses of the wafers W before polished are different, parallel and flat processing can be carried out at high accuracy. The machine can be thereby miniaturized. Furthermore, by transferring the shape of the polishing plates which influences the accuracy in the polishing onto a work piece, parallel and flat processing can be carried out at high accuracy even if a work piece having a large diameter is polished.

The present invention is not limited to the above embodiment and, of course, can be modified variously in a range which does not exceed the gist of the present invention.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A method of polishing, comprising the steps of:

rotatably supporting a workpiece;

positioning a plurality of polishing plates in such a manner that flat surfaces of the polishing plates oppose one another and are in contact with a surface of the workpiece;

polishing the workpiece by rotating the workpiece around a central axis thereof by use of a workpiece rotator; and reciprocating the polishing plates on the surface of the workpiece in a radial direction of the workpiece while pressing the workpiece between the flat surfaces of the polishing plates.

2. A method of polishing according to claim 1, further comprising the step of:

providing a polishing cloth on each of the flat surfaces of the polishing plates.

3. A method of polishing according to claim 1, wherein the polishing plates are reciprocated while pressure is exerted thereon via a flexible joint.

4. A method of polishing according to claim 1, wherein the polishing plates are rotated while being reciprocated.

5. A method of polishing according to claim 1, wherein at the step of polishing, a magnetic force is exerted onto the surface of the workpiece, and a polishing liquid containing a magnetic fluid is supplied onto the surface of the workpiece.

6. A method of polishing according to claim 1, wherein the workpiece is a semiconductor wafer.

* * * * *